United States Patent [19]

Vargo

[11] 4,023,683

[45] May 17, 1977

[54] INTERNALLY REINFORCED LOAD CARRYING MEMBER

[76] Inventor: William R. Vargo, c/o Husky Storage Systems, Inc., 9111 Nevada Ave., Cleveland, Ohio 44104

[22] Filed: Mar. 12, 1975

[21] Appl. No.: 557,802

[52] U.S. Cl. ..... 211/192; 52/720

[51] Int. Cl.[2] ..... A47B 43/00

[58] Field of Search ..... 211/176, 177, 182, 183, 211/175, 134, 148, 191, 192, 187; 52/720, 731; 182/128, 187; 138/115–117; 29/185, 186

[56] References Cited

UNITED STATES PATENTS

| | | | |
|---|---|---|---|
| 1,360,774 | 11/1920 | Mooney et al. | 52/731 |
| 1,588,327 | 6/1926 | Mooney | 52/731 |
| 2,950,826 | 8/1960 | Degener | 211/191 |
| 3,392,848 | 7/1968 | McConnell et al. | 211/176 |
| 3,612,290 | 10/1921 | Evans | 211/176 |
| 3,647,079 | 3/1972 | Ohlin | 211/176 |

FOREIGN PATENTS OR APPLICATIONS

| | | | |
|---|---|---|---|
| 212,526 | 12/1960 | Austria | 211/182 |
| 1,210,528 | 2/1966 | Germany | 211/176 |
| 6,408,376 | 1/1965 | Netherlands | 211/182 |
| 446,644 | 3/1968 | Switzerland | 211/176 |
| 447,029 | 3/1968 | Switzerland | 211/176 |

*Primary Examiner*—Roy D. Frazier
*Assistant Examiner*—Terrell P. Lewis
*Attorney, Agent, or Firm*—Meyer, Tilberry & Body

[57] ABSTRACT

A structural member primarily intended for the horizontal and vertical load carry members of industrial storage racks. The member is hollow and has an internal reinforcing web extending across the interior in the plane of the maximum anticipated bending stress and abutting against the walls of the member. The walls on each side of the web are so formed as to provide a pair of opposed channels or grooves on the inside of the member which receive the edges of the web and provide lateral support therefor to prevent the web from buckling sideways under bending stresses in the plane of the web. These edges are preferably spot welded to the walls of the member. When the member is to be used in a storage rack, it is preferably generally rectangular in cross-section with the corners facing the front being angled at approximately 45° to the front surface of the member for a distance of at least one half of the total width of the member so as to deflect mis-aligned articles being placed onto the shelves of the rack. Openings for receiving locking pins on brackets supporting the horizontal load supporting bars are located in the side walls of the posts but spaced substantially from the front and back walls of the post so as to effect a minimum weakening of the members.

13 Claims, 4 Drawing Figures

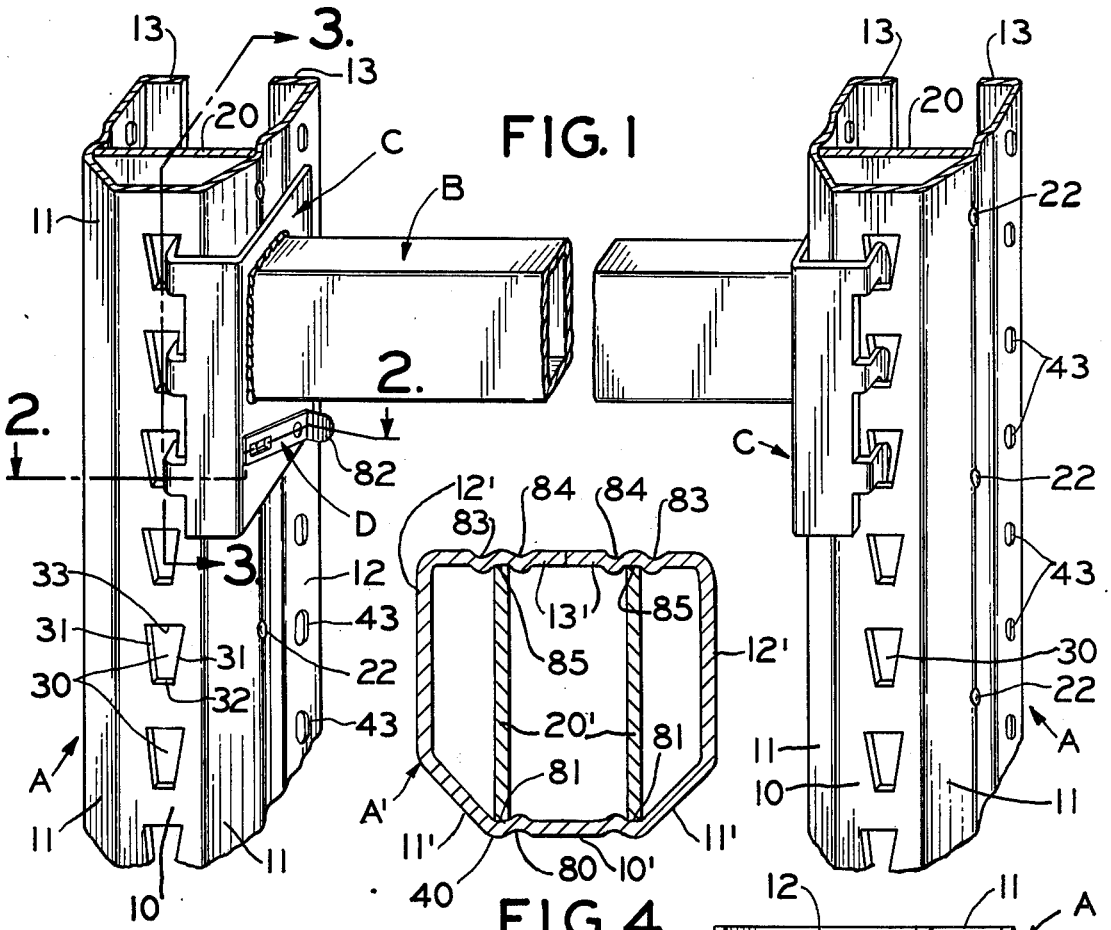
FIG. 1
FIG. 4
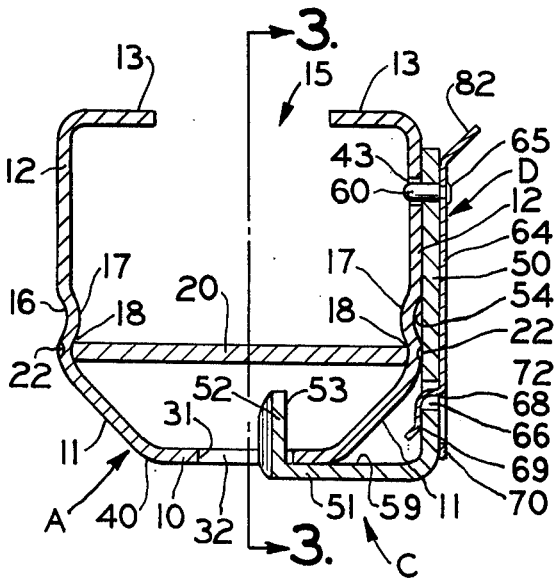
FIG. 2
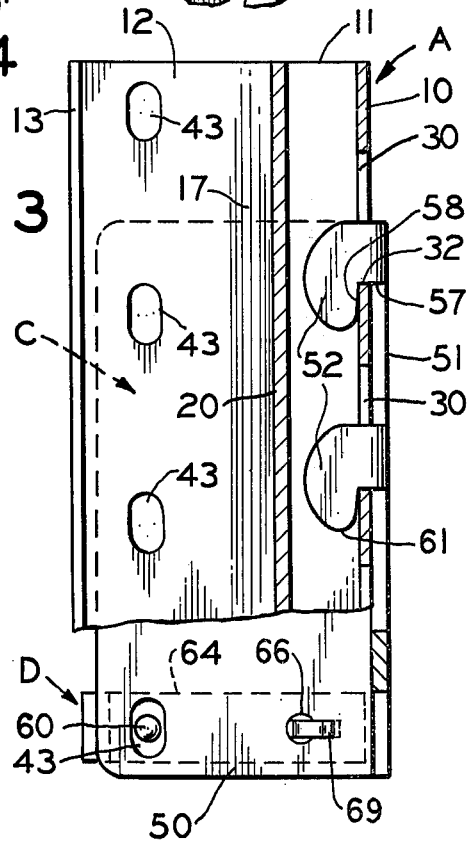
FIG. 3

INTERNALLY REINFORCED LOAD CARRYING MEMBER

This invention pertains to the art of hollow structural load carrying members and more particularly to a structural member having an internal reinforcing web which gives a maximum load carrying strength for a minimum cross-sectional area of material.

The invention is particularly applicable to the art of storage racks for the storing of heavy, bulky articles of commerce and will be described with particular reference thereto although it will be appreciated that the invention has other broader applications.

In storage racks, there are ordinarily a number of pairs of front and back vertical members spaced longitudinally with a plurality of vertically adjustable horizontally extending support members fastened at selected points to the vertical members. These support members are often used to support extremely heavy articles of commerce, which articles must be moved into/or off of the supporting members by means of manually or power operated lift trucks. The weight of the materials placed on the horizontal members exerts substantial bending forces on both the horizontal and the vertical members which must be strong enough to resist same without buckling or otherwise failing.

A further problem with such storage racks has been that when heavy loads are to be placed on or removed from the horizontal support members, often times the operator of the lift truck will not accurately align the load with the opening and the load or the truck, or both, may strike either a vertical or a horizontal member resulting in a bending thereof and a weakening of its load carrying capabilities. The present invention provides a cross-sectional configuration designed to deflect the load, or the lift truck, toward the opening whereby the members will be less subject to damage from such impacts.

A further problem with such vertical members has been that the brackets which connect the horizontal members to the vertical members must be locked in place and the openings in the vertical members required to coact with the bracket heretofore have resulted in a weakening of the strength of the vertical members against bending or the carrying of the vertical loads.

In accordance with the present invention, a hollow structural member having side walls of uniform thickness is provided in combination with an internal reinforcing web extending across the interior of the member in the anticipated plane of the maximum bending stress to be exerted on the member and abutting against the side walls, such side walls on each transverse side of the web being so formed as to provide a pair of opposed longitudinally extending channels, or grooves, on the inside of the member which receive the edges of the web to provide lateral support for the edges and prevent the web from buckling sideways under bending stresses in the plane of the web. In a limited facet of the invention, web edges are spot welded at spaced points to the walls of the member further contributing to the strength contributions of the web.

In a preferred embodiment, the channels on the inner surface of the walls of the member are provided by rolling one or more longitudinally extending indentations into the outer surface of the wall to form the groove or channel on the inner surface of the wall. This indentation is not of sufficient depth to weaken the wall but in preventing the edges of the web from moving transversely do enable the web to contribute to the load carrying ability of the member.

In a preferred embodiment of the invention, when the maximum bending stresses are in a plane parallel to the front of the member, the web extends from side wall to side wall of the vertical member and spaced from the front and back surfaces. When the maximum bending stresses are in a plane perpendicular to the front wall, the web extends in a fore and aft direction and spaced from the side walls.

When the member is horizontal and extends between vertical members, the plane of the web will be vertical and spaced from the front and back walls.

Further, in accordance with the invention, when the member is used in a storage rack, the front wall is of approximately one third the width of the member and is joined with parallel side walls by deflector walls each extending at an obtuse angle (preferably 135°) to both the front and side walls whereby when the articles slightly mis-aligned are moved into the storage rack, they will be deflected to the opening by such deflector walls. In such instance, each web edge receiving recess is formed by the inner surface of the angled portion and a longitudinally extending bulge on the inner surface of the side wall close spaced to the angled portion.

Further, in accordance with the invention, the front wall has a plurality of bracket hook receiving openings spaced longitudinally therealong and the side walls have a plurality of similar spaced openings spaced to the rear of the bulge for receiving a locking pin on the bracket of the horizontal extending members of the rack.

It is of course old to provide hollow structural members with internal reinforcing webs but it is believed that I am the first to have deformed the walls of the member with one or more longitudinally extending bulges of sufficient depth to form a recess or groove to receive the edges of the web whereby the edges are supported laterally and the web is prevented from buckling under stresses in the plane of the web.

Further, it is believed that I am the first to have provided the structural members of a storage rack with angled corners such that mis-aligned particles are readily deflected into the storage spaces of the rack.

The principal object of the invention is the provision of a new and improved load carrying member which has a maximum load carrying strength for a given amount of material.

Another object of the invention is the provision of a new and improved hollow load carrying member having an internal web extending across the inside thereof and abutting against the inner surfaces of the side walls of the member, the inner surface of the side walls of the member being so formed as to provide a longitudinally extending recess into which the web edges fit whereby the web is restrained from buckling under heavy loads through the plane of the web and the member is strengthened.

Still another object of the invention is the provision of a new and improved load carrying member for storage racks which has a cross-sectional configuration designed to deflect misaligned articles being placed in the storage rack toward the openings of the storage racks without damaging the members.

Another object of the invention is the provision of a new and improved structural member for storage racks having a front surface and side surfaces joined by an angled or curved deflector portion forming an obtuse angle, preferably of 135°, with the plane of the front and side walls.

Another object of the invention is the provision of a structural member for storage racks or the like having an internal web extending spaced walls of the member and prevented from buckling under stresses by so forming the inner surface of the walls of the member as to provide lateral support of the edges of the web member.

The invention may take physical form in certain parts and arrangements of parts, preferred embodiments of which will be described in detail in this specification and illustrated in the accompanying drawings which form a part hereof and wherein:

FIG. 1 is a perspective view of a portion of a storage rack illustrating a preferred embodiment of the present invention;

FIG. 2 is a cross-sectional view of FIG. 1 taken approximately on the line 2—2 thereof;

FIG. 3 is a cross-sectional view of FIGS. 1 and 2 taken approximately on the lines 3—3 thereof with portions broken away to show the clip arrangement; and FIG. 4 is a cross-sectional view of a vertical member where the major anticipated bending stresses are in a plane perpendicular to the plane of the front of the rack.

Referring now to the drawings wherein the showings are for the purposes of illustrating preferred embodiments of the invention only and not for the purposes of limiting same, the FIGURES show a portion of a storage rack including a pair of vertically extending posts A and a horizontal supporting beam B adjustably fastened to the vertical posts A by means of a brackets C, such brackets having a locking arrangement D for preventing accidental displacement from the posts 10 in the event of an upward force thereon.

The post A in the embodiment shown is an elongated strip of heavy gauge sheet material formed to a generally U shaped cross-section so as to include a front wall 10, a pair of deflector walls 11 each extending from a respective side edge of the front wall 10 backwardly and outwardly at an angle, a pair of side walls 12 each extending backwardly from the rear edge of the deflector wall 11 and a pair of flanges 13 each extending tranversely towards each other from the rearmost edge of the side walls 12.

The material from which the post A is formed may be metal or plastic but is preferably sheet steel. The gage or thickness depends on the maximum loads to be carried. The flanges 13 may extend into abuttment if desired and the abutting edges may be welded togehter if desired.

The deflector wall 11 at its front edge forms an obtuse angle A with the side edge of the front wall 10 which angle A is preferably 135° although it may vary from a maximum of 150° down to 105°. The purpose of this angle is to provide a surface which angles inwardly and outwardly from the center fore and aft plane of the post A toward the storage space of the storage rack. Thus any item which should strike the outer surface of the deflector wall 11 will tend to be deflected toward the opening of the rack and will be less likely to bend the post A as would be the case if this surface were coplaner with the surface of the front wall i.e. if the front and side walls met at the conventional filleted sharp corner of the prior art.

In accordance with the invention, each side wall 12 has an indentation 16 therein slightly spaced from the rear edge of the deflector wall 11 which indentation forms a bulge 17 on the inner surface of wall 12 and which bulge 17 in combination with the angled inner surface of deflector wall 11 forms a longitudinally extending recess 18 or groove on the inside of the post A spaced to the rear of the inner surface of front wall 10. There are two such recesses 18 which are transversely opposite one from the other.

In accordance with the invention, a web 20 of a width generally equal to the transverse spacing between the bases of the two recesses 18 extends longitudinally in the post A and its edges are preferably welded at least at spaced points 22 to the inner surface of the wall 12, that is to say the surface or apex of the recess 18. It is to be particularly noted that the width of the web 20 is at least greater than the lateral spacing between the two bulges 17. Thus, if for any reason, the welds 22 should break, the edges of the web 20 will be laterally supported and prevented from making fore and aft, i.e. buckling relative to the post A. The physical strength of the web 20 thus contributes to the physical strength of the post A against bending forces in the plane of the web member 20.

The formation of the oppositely disposed recesses 18 and the positioning of the web 20 extending between these two recesses is an important part of the present invention and contributes substantially to the strength of the post A while at the same time not adding materially to the total cross-sectional area of the material in the post.

The front wall 10 is provided with a plurality of vertically spaced openings 30, which as will appear provide a means whereby the bracket members C may be fastened to the post A at vertically adjustable heights. These openings 30 may be T shaped or key-hole shaped but preferably have generally the shape of an inverted frusto-cone each having upwardly diverting side edges 31, a lower edge 32 and an upper edge 33 of a greater width than the lower edge 32. The front wall 10 is generally of a width somewhat greater than the length of the edge 33 and in the preferred embodiment has a dimension of approximately 1.5 inches.

The deflector wall 11 as indicated extends at an angle of approximately 135° relative to the front wall 10 and is joined with the front wall 10 by a smooth radius 40.

The horizontal length of the deflector portion 11 may be as desired but preferably the lateral width of the deflector portion is such that the sum of the two transverse widths of both deflector portions 11 is equal to the width of the front wall 10. i.e. the front wall is approximately one third the total width. Obviously, the ratio may be as desired it being appreciated that the greater the transverse width of the deflector wall 11 relative to the transverse width of the post A, the greater will be the width of the surface which can deflect mis-aligned articles being placed in the storage rack into the storage space thus preventing physical damage to the post A.

The width of the flanges 13 may be as desired and may, or may not, extend at right angles to the side walls 12. Thus, the flanges 13 may extend completely across the back of the post A if desired and may be welded together although this has not found to be necessary. In the embodiment shown the free edges of the flanges 13 are spaced to define an opening 15.

Further, in accordance with the invention, the side walls 12 between the indentation 16 and the flanges 13 are each provided with a plurality of openings 43 spaced vertically the same distance as the center of the front wall openings 30. These openings are slightly vertically elongated as shown.

In the embodiment of the invention shown, the brackets C include a side wall 50, a front wall 51 extending generally at right angles to the side wall 50 with the side edge thereof terminating in a plurality of rearwardly extending hook members 52. These hooks 52 have a vertical dimension less than the vertical height of openings 30 and are spaced the same as the openings 30. They angle downwardly and outwardly at the same angle as edges 31. The surface 58 of hook 52 is spaced from the inner surface 59 of front wall 51 a distance at least equal to the thickness of the metal of the front wall 10.

In the preferred embodiment, three such hook members are provided although more or less may be provided. Each hook member 52 has an inner surface 53 spaced from an inner surface 54 of the side wall 50 a distance equal generally to the spacing from the lowermost end of the side edges 31 of the front wall openings 30 from the plane of the side wall 12 such that when the bracket C is placed in position on the post A, the inner surface 53 will engage the edge 31 and as the bracket member moves downwardly will draw the inner surface 54 into close abutting engagement with the outer surface of the side wall 12.

The bracket member C, as indicated, is provided with a retractable pin 60 so that once the hook members 52 are positioned in the openings 30 and the bracket member C has been lowered until the bearing surface 57 of the hook 52, engages lower edge 32 of an openings 30, the pin 60 will fit into one of the openings 43. Such openings 43 are of a vertical dimension such that when the pin 60 is positioned therein, the bracket member C cannot be raised in amounts sufficient to have the lower end 61 of the hook 52 clear the edge 32 of the openings 30.

In the preferred embodiment, the pin 60 is slidable mounted in an opening in the side wall 50 and is spring biased toward the opening 43 by means of a leaf spring 64. In the embodiment shown, the pin 60 has a head which extends through the leaf spring 64 and is riveted over as at 65.

The spring 64 may be held in position on the bracket member in any desired manner but in the preferred embodiment, the side wall 50 has an opening 66 spaced from the opening 63 and the spring member 64 has a tab struck from the center thereof which tab includes a transverse portion 68 which extends through the opening 66 and a gripping portion 69 which frictionally engages the inner surface 54 of the side wall 50. The length of the spring member 64 is such that the end 70 of the spring member 64 extends beyond the opening 66 and engages the outer surface of the side wall 50 while the gripping portion 69 engages the inner wall.

A stop 72 is provided on the surface of the spring 60 which engages or lies against the outer surface of the side wall 50 which stop is so positioned as to engage a side of the opening 66 so that the spring member is locked into position in the opening 66.

The spring member 64 has an outwardly extending tab 82 at its free end so that the spring may be manually bent away from the outer surface of the side wall 50 thereby withdrawing the pin 60 from the opening 43 in the side wall 12 of the vertical post A.

The openings 43 do not appreciably reduce the vertical strength of the posts A. Because they are generally on or close to the neutral axis of the side walls which are not stressed when either vertical loads are imposed on the posts A by the brackets C or when loads are placed on the posts A by virtue of weights positioned intermediate the ends of the horizontal beams.

It will be appreciated that the edges of the web 20 be welded to the base of the recess 18 in any desired manner, but in the preferred embodiment, a spot welding machine is employed which exerts a welding action from the outer surface of the wall 12 through the thickness of the metal to the edge of the web 20.

In the alternative, it would be possible to weld the edges of the web 20 to the inner surfaces of the side wall 12 by means of arc welding or brazing equipment with access through the space 15 between the spaced edges of the flanges 13.

The web 20 preferably extends from the bottom of post A at least partway up its length.

The thickness of the sheet metal which forms the various walls of the posts may be as desired depending upon the ultimate load to be carried. In the preferred embodiment, the metal has a thickness of 3/32 inch.

The web 20 may, in a like manner, be of any desired thickness, it having been found that as the thickness of the web 20 increases, the vertical load carrying capabilities of the post A also increase. Thus, in a post without web 20 and formed of 3/32 inch steel and having a three inch depth of thickness and a 3.15 inch thickness web 20, the load carrying capacity increased to 40,000 pounds. With a web 20 of 0.25 inches thickness, the load carrying capacity increased to 50,000 pounds.

It is to be noted that there are two forms of loads on the post A, one is the vertical compession force due to the weight of materials placed on the horizontal members B. In addition, any weights placed on the horizontal members B exert a rotational force or torque on the post A, the plane, of which force is generally parallel to the front wall 10 and to the plane of the web 20. By placing the web 20 closer to the front wall 10 of the post A, it is in an improved position to assist in resisting this bending or twisting force.

By virtue of having the web 20 spaced from the rear surface of the front wall 10, room is provided for the hooks 52 to enter through the openings 30 and to be lowered into position such that these hooks will engage the inner surface of the front wall 10.

It is to be further noted that there is a transfer of loading from the bracket C to the post A by virtue of the pin 60 engaging the walls of the opening 63 in the side wall 50 of the bracket member C and also engaging the walls of the openings 43 in the side wall 12 of the post A. The pin 60 also helps to prevent rotation of the bracket C relative to post A.

In a practice with a 3.15 inch wide post the width of the front wall 10 is approximately 1½ inches while the transverse width of each deflector wall is approximately ¾ inch. Obviously, if the post had a greater width, or a lesser width, these dimensions would be changed proportionately.

As indicated, deflector walls 10 tend to deflect any article being inserted into the storage rack toward the opening of the storage rack if the operator should misalign the article as he is inserting it. Furthermore, the web 20 gives a rigidity to the post A against torsion due to such impact and also rigidity against sideward bending of the post A under the force of such impact.

The depth of the indentations is normally just enough to provide a groove on the inside of a depth to support the edges of the web against transverse movement and not enough to unduly weaken the strength of the wall in which it is formed. Normally this depth is not in excess of the thickness of the wall. Further, the web is flat and of a thickness usually greater than that of the walls, both of which features would distinguish the present invention over the construction shown in U.S. Pat. Nos. 1,306,952 or 360,720. The web for a given cost of manufacture gives maximum increase in strength to the member.

While the indentation might in some instances be eliminated and the welds only used to locate and maintain the web edges against movement transverse to the plane of the web, the construction shown is preferred because if a weld should for any reason fail, the web edges are still held against such movement. So long as the web is held against such transverse movement, it retains its strength against buckling under load and thus failure.

FIG. 4 shows an alternative embodiment of the invention, particularly of value in a vertical post when the forces imposed thereon are bending in a fore and aft direction. In this embodiment, like numbers are used to designate like parts to that of the preferred embodiment with a prime mark (′) added.

Thus, in this embodiment, the front wall 10′ is provided with a plurality of indentations 80 spaced from the intersecting corner between the deflector wall 11′ and the front wall 10′ to provide longitudinally extending recesses 81. In a similar manner, the back wall 13′ is provided with two pairs of indentations 83, 84 to define a recess 85 on the inner surface of the back wall 13′ which is directly opposite the recess 81. A web 20′, of a width such that its edges will bear against the base of the recesses 81, 85, extends longitudinally within the post A′. As shown there are two of such webs 20′ provided in this embodiment of the invention.

It will be appreciated that if either post A or A′ were placed horizontally with the plane of the webs 10 or 20′ vertical, either would be able to function as a beam extending between other posts and would be able to carry substantial vertical loads between its ends.

Having described my invention, I claim.

1. A structural member for supporting heavy loads comprised of a hollow rigid member having walls of generally uniform thickness and a reinforcing web extending across the interior of said member between said walls, said walls having at least a pair of external longitudinally extending indentations causing a pair of longitudinally extending beads on the inside of the said walls, means coacting with each of said beads to define therewith a longitudinally extending shallow groove with said grooves being oppositely disposed, the longitidinal edges of said web bearing against the bases of said recesses whereby the sides of said recesses restrict movement of said edges in a direction perpendicular to the plane of said web, whereby said web contributes to the bending strength of said hollow member.

2. The combination of claim 1 wherein the edges of said web are spot welded at spaced points to the bases of said grooves.

3. The combination of claim 1 wherein said walls comprise a front wall and a pair of side walls and a deflector wall integrally joining said front and side walls and extending at an angle of approximately 135° relative thereto, said external indentation being in said side walls and close spaced from the corner interconnecting said side walls and said deflector wall whereby the beads caused by said indentations and said corners define said longitudinally extending grooves and said web is spaced from said front wall.

4. The member of claim 1 wherein said member is comprised of a front wall, a pair of side walls integrally joined by a deflector wall extending at an angle approximately 135° relative thereto and a rear wall opposite from said front wall, said deflector wall joining said front wall at a corner, the external surface of said rear wall having a pair of longitudinally extending indentations to cause a pair of longitudinally beads on the inside of said wall to define a longitudinally extending groove on the inner surface of said wall, said groove generally opposite said corner and a longitudinally extending indentation on said front wall spaced from said corner whereby the bead on the inside of said wall and said corner defined a longitudinally extending groove.

5. A storage rack for heavy weights comprised of a plurality of horizontally spaced, vertically extending posts and a plurality of vertically spaced horizontal beams extending between adjacent posts, said beams forming a shelf on which weights are to be disposed, said vertical posts being sheet material formed into a generally hollow construction comprised of a front wall of a predetermined width, a pair of deflector walls each extending at an obtuse angle rearwardly from respective edges of said front wall, a pair of side walls extending rearwardly from respective rear edges of said deflector walls and generally parallel to each other and at an obtuse angle to said deflector walls and a pair of back flanges extending transversely towards each other from a respective rear edge of said side walls, wherein said side walls have a longitudinally extending buldge on the inner surface closed spaced from the apex of the angle formed by the junction of said deflector wall and said side walls forming a longitudinally extending recess spaced from said front wall and said back flange, a longitudinally extending web extending between the bases of said recesses and of a width greater than the spacing between said bulges whereby the edges of said web are restricted against movement in a direction perpendicular to the plane of the web.

6. The improvement of claim 5 wherein the edges of said web are welded at least at spaced points to the base of said recesses.

7. The improvement of claim 6 wherein the width of said front wall is approximately half the spacing of said side walls and said deflector walls are at an angle of approximately 135° to said front and said side walls.

8. A vertical post for vertical loads comprised of a length of sheet material of uniform thickness formed to provide:

a. a front wall of predetermined width,
b. a pair of deflector walls each extending at an obtuse angle rearwardly from respective edges of said front wall,
c. a pair of side walls extending rearwardly from a respective rear edge of each of said deflector walls and generally parallel to each other and at an obtuse angle to said deflector walls,
d. a longitudinally extending bulge on the inner surface of each of said side walls close spaced from the apex of the angle formed by said deflector wall and said side wall forming a longitudinally extending recess spaced from said front wall and said back flanges, a longitudinally extending web extending between the bases of said recesses and of a width greater than the spacing between said bulges, e. a pair of back flanges extending transversely towards each other from a respective rear edge of said side walls.

9. The post of claim 8 including means fastening at least portions of the longitudinal edges of said web to the bases of said recesses.

10. The post of claim 8 wherein the width of said front wall is approximately half the spacing of said side wall and said angled portions are at an angle of approximately 135° relative to the plane of said front wall and said side wall.

11. the post of claim 8 wherein said walls between said bulge and said back flanges have a plurality of openings spaced longitudinally thereon and said front wall has a plurality of longitudinally spaced openings, the vertical spacing of said openings in said front and side walls being substantially the same.

12. The post of claim 11 wherein a bracket member is provided adapted to connect a horizontally extending member to said vertical posts, said bracket member having a front wall, a side wall extending rearwardly from one edge of said front wall, and a plurality of hook members extending rearwardly from the other edge of said front wall, said hook members having a downwardly extending hook portion with a front surface spaced from the plane of the back surface of said front wall a distance generally equal to the thickness of the metal of said post front wall and a retractable pin member in said side wall adapted to engage in the openings in the side walls of said vertically extending posts.

13. The combination of claim 12 wherein spring means are provided for biasing said retractable member toward the inner surface of said side walls.

* * * * *